US012479633B2

(12) United States Patent
Lai

(10) Patent No.: US 12,479,633 B2
(45) Date of Patent: Nov. 25, 2025

(54) BEVERAGE CONTAINER LID

(71) Applicant: Sara Rose International INC., New Taipei (TW)

(72) Inventor: James Lai, New Taipei (TW)

(73) Assignee: Sara Rose International INC., New Taipei (TW)

( * ) Notice: Subject to any disclaimer, the term of this patent is extended or adjusted under 35 U.S.C. 154(b) by 228 days.

(21) Appl. No.: 18/398,164

(22) Filed: Dec. 28, 2023

(65) Prior Publication Data

US 2025/0214755 A1 Jul. 3, 2025

(51) Int. Cl.

| | |
|---|---|
| ***B65D 43/02*** | (2006.01) |
| ***A47G 19/22*** | (2006.01) |
| ***B65D 47/30*** | (2006.01) |
| ***B65D 47/32*** | (2006.01) |
| ***B65D 53/02*** | (2006.01) |

(52) U.S. Cl.

CPC ..... *B65D 47/305* (2013.01); *A47G 19/22* (2013.01); *B65D 43/0202* (2013.01); *B65D 47/32* (2013.01); *B65D 53/02* (2013.01); *B65D 2205/02* (2013.01); *B65D 2543/00092* (2013.01); *B65D 2543/00537* (2013.01); *B65D 2543/00972* (2013.01)

(58) Field of Classification Search

CPC .. B65D 47/305; B65D 43/0202; B65D 47/32; B65D 53/02; B65D 2205/02; B65D 2543/00092; B65D 2543/00537; B65D 2543/00972; A47G 19/2272

See application file for complete search history.

(56) References Cited

U.S. PATENT DOCUMENTS

| | | | | |
|---|---|---|---|---|
| 2,979,238 | A * | 4/1961 | Bramming | B65D 47/305 222/536 |
| 4,282,991 | A * | 8/1981 | Hazard | B65D 47/305 222/536 |
| 5,797,521 | A * | 8/1998 | Sobral | B65D 47/305 222/534 |
| 5,873,478 | A * | 2/1999 | Sullivan | A47G 19/2266 222/534 |
| 5,908,126 | A * | 6/1999 | Wang | B65D 47/305 220/837 |
| 6,793,104 | B2 * | 9/2004 | Kao | B65D 39/0052 222/481.5 |
| 8,459,502 | B2 * | 6/2013 | Swanick | B65D 47/32 222/536 |
| 9,573,738 | B1 | 2/2017 | Lai | |

(Continued)

*Primary Examiner* — Frederick C Nicolas

(74) *Attorney, Agent, or Firm* — Fei-Hung Yang

(57) ABSTRACT

A beverage container lid including a cover, a pivot valve, and a waterproof gasket is provided. The pivot valve includes a semi-spherical pivot portion with a semi-spherical surface. When the pivot valve is rotated to a first pivot position, a flow through hole of the waterproof gasket is sealed by a flange on a periphery of the semi-spherical surface. A long groove which includes an opening facing outside, a front end portion, and a rear end portion opposite to the front end portion is disposed on a surface of the flange in a pivoting direction. When the pivot valve is rotated to be away from the first pivot position, the front end portion of the long groove is communicating with the air hole of the waterproof gasket. Thereby air inside a beverage container can flow outside through the long groove and the rear end portion.

6 Claims, 18 Drawing Sheets

(56) References Cited

U.S. PATENT DOCUMENTS

| | | | | |
|---|---|---|---|---|
| 12,351,368 | B1 * | 7/2025 | Zhu | B65D 47/065 |
| 2003/0111493 | A1 * | 6/2003 | Kao | B65D 39/0052<br>222/481.5 |
| 2012/0181277 | A1 * | 7/2012 | Wang-Wu | B65D 47/305<br>220/212 |
| 2012/0234789 | A1 * | 9/2012 | Mason | B65D 47/36<br>215/229 |

* cited by examiner

BEVERAGE CONTAINER LID

BACKGROUND OF THE INVENTION

The present invention relates to a beverage container, especially to a beverage container lid.

Refer to U.S. Pat. No. 9,573,738 B1 (Chinese Pat. No. 205132001U) applied by the same inventor of the present invention, a beverage container is revealed. The beverage container cap makes a beverage container cap in a closed or open state by a waterproof gasket in combination with a pivot valve. A liquid through hole and at least one vent are integrally formed and arranged at the waterproof gasket. Thus there is no need to produce a specific waterproof gasket with the vent. Problems raised such as difficulty in mounting of the specific waterproof gasket on the vent of the cap, easy falling-off of the waterproof gasket, or even risk of ingestion are solved.

However, when liquid in the beverage container is carbonated water (such as cola) or hot drinks (such as hot coffee), a pressure inside the beverage container rises as the amount of gases accumulate and increases. When the pivot valve is rotated from a first pivot position in the closed state to a second pivot position in the open state, the carbonated water or hot drinks in the beverage container is getting sprayed through an outlet of the pivot valve due to the increased pressure in the beverage container. People are likely to get burn injuries or the drinks spilled over cause stains on their clothes.

SUMMARY OF THE INVENTION

Therefore, it is a primary object of the present invention to provide a beverage container lid which includes a cover, a pivot valve, and a waterproof gasket. The pivot valve includes semi-spherical pivot portion with a semi-spherical surface. When the pivot valve is rotated to a first pivot position, an air hole of the waterproof gasket is sealed by compression of at least one flange on the periphery of the semi-spherical surface. A long groove with an opening facing outside, a front end portion, and a rear end portion opposite to the front end is disposed on a surface of the flange in a pivoting direction. The front end portion of the long groove is communicating with the air hole of the waterproof gasket when the pivot valve is rotated to be away from the first pivot position. Thus air inside a beverage container can be flowing to the outside through the long groove and the rear end portion. Therefore, a problem of spraying of beverages through the pivot valve due to high pressure of gases in the beverage container can be solved.

In order to achieve the above object, a beverage container lid according to the present invention includes a cover, a pivot valve, and a waterproof gasket. The cover is detachably mounted to an opening on a top end of a beverage container. The cover is provided with a valve seat disposed on a top surface thereof and having a chamber, a liquid through hole with a through-hole edge, and at least one vent hole arranged at a periphery of the through-hole edge. The liquid through hole is disposed on a bottom of the chamber and penetrating the cover to communicate with an inner space of the beverage container. The waterproof gasket is fixed on the liquid through hole or the through-hole edge on the bottom of the chamber. The waterproof gasket consists of a flow through hole, a flow through hole edge of the flow through hole, and at least one air hole arranged at a periphery of the flow through hole edge. The flow through hole and the air hole are respectively communicating with the liquid through hole of the cover and the vent hole around the through-hole edge of the cover. The pivot valve is mounted in the chamber of the valve seat and able to be rotated. The pivot valve includes a semi-spherical pivot portion, a nozzle portion, a channel, and at least one flange. The semi-spherical pivot portion is located at a bottom of the pivot valve and provided with a semi-spherical surface while the nozzle portion is formed by extension of the semi-spherical pivot portion. The semi-spherical surface of the semi-spherical pivot portion is compressed and sealed on the flow through hole of the waterproof gasket to create a tight seal. The semi-spherical surface is able to be rotated from a first pivot position to a second pivot position or in a reverse direction along with the pivot valve synchronously. The channel is mounted inside the nozzle portion and provided with a water inlet and a water outlet disposed on two ends of the channel correspondingly. The water inlet is extended and located at the semi-spherical surface of the semi-spherical pivot portion while the water outlet is located on one end of the nozzle portion opposite to the semi-spherical pivot portion for allowing users to suck up. The flange is arranged at a preset position of a periphery of the semi-spherical surface of the semi-spherical pivot portion. When the pivot valve is rotated to the first pivot position, the water inlet on the semi-spherical surface of the pivot valve is moved away from the flow through hole of the waterproof gasket and the flow through hole of the waterproof gasket is tightly sealed by compression of the semi-spherical surface. At the same time, the air hole of the waterproof gasket is tightly sealed by compression of the flange on the periphery of the semi-spherical surface. Thus the lid is in a closed state. When the pivot valve is rotated to the second pivot position, the water inlet on the semi-spherical surface of the pivot valve is aligned with the flow through hole of the waterproof gasket to be in a communicating state. At the same time, the flange on the periphery of the semi-spherical surface is away from the air hole of the waterproof gasket so that the air hole of the waterproof gasket is communicating with the outside through the vent hole on the cover. Thus the lid is in an open state.

A long groove with an opening facing outside is disposed on a surface of the flange on the periphery of the semi-spherical surface of the pivot valve in a pivoting direction. The long groove includes a front end portion and a rear end portion opposite to each other. When the pivot valve is rotated to be away from the first pivot position, the front end portion of the long groove is communicating with the air hole of the waterproof gasket. Thus air inside the beverage container is flowing to the outside through the long groove and the rear end portion of the long groove. Therefore, a problem of spraying of beverages through the pivot valve due to high pressure of gases in the beverage container can be solved.

Preferably, the waterproof gasket further includes a concave surface able to attach to the semi-spherical surface of the pivot valve correspondingly. While the pivot valve is turned from the first pivot position to the second pivot position or in opposite direction, the semi-spherical surface of the pivot valve is attached to and sliding on the concave surface.

Preferably, both the cover and the pivot valve are integrally formed by plastic injection molding.

Preferably, he waterproof gasket is integrally formed by silicone molding.

DETAILED DESCRIPTION OF THE PREFERRED EMBODIMENT

Figure 2:
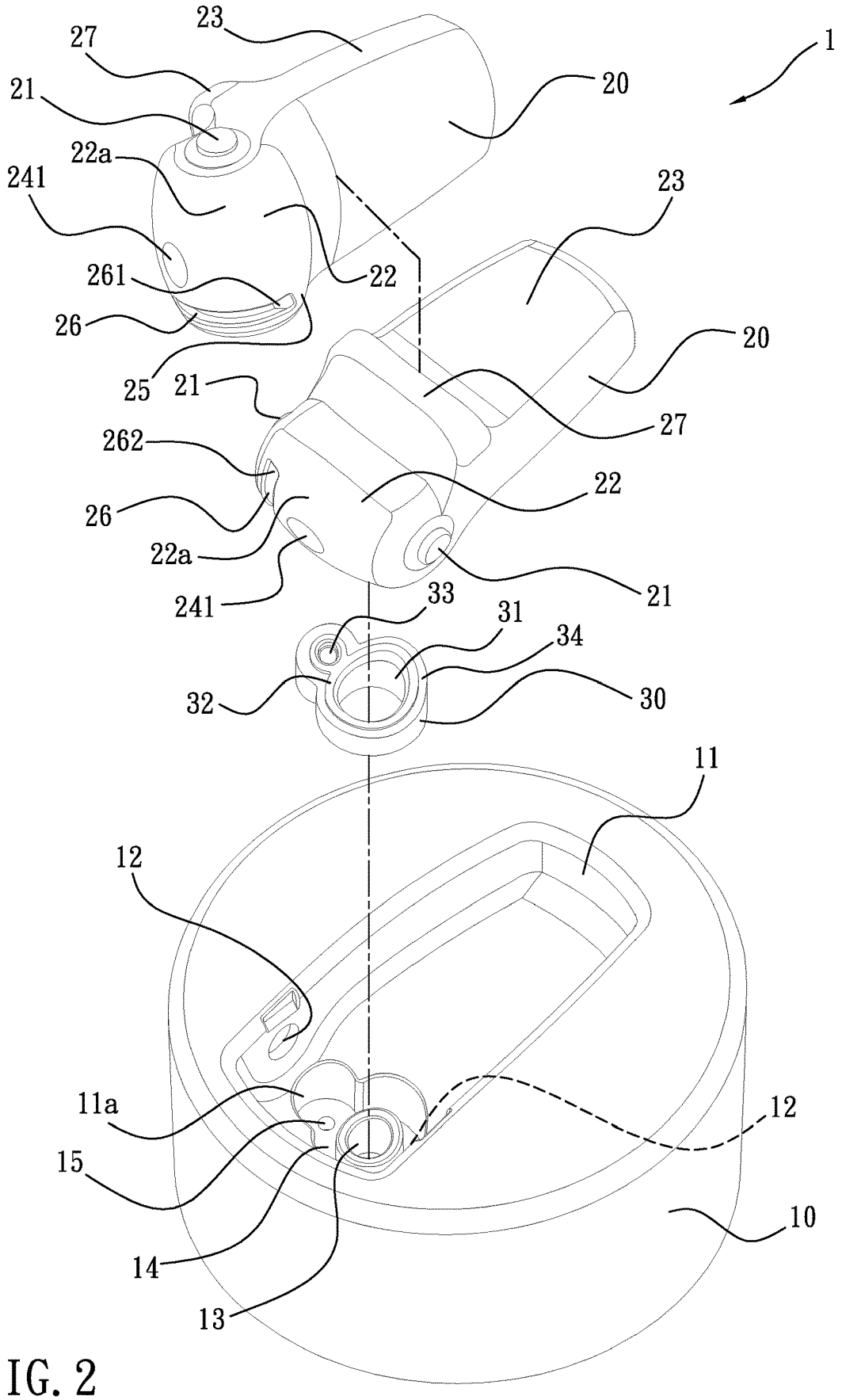
FIG. 2 is an exploded view of an embodiment of a lid viewed from one angle according to the present invention.

Refer to FIG. 2, a beverage container lid 1 includes a cover 10, a pivot valve 20, and a waterproof gasket 30. The cover 10 is detachably mounted to an opening on a top end of a beverage container 2.

Figure 7:
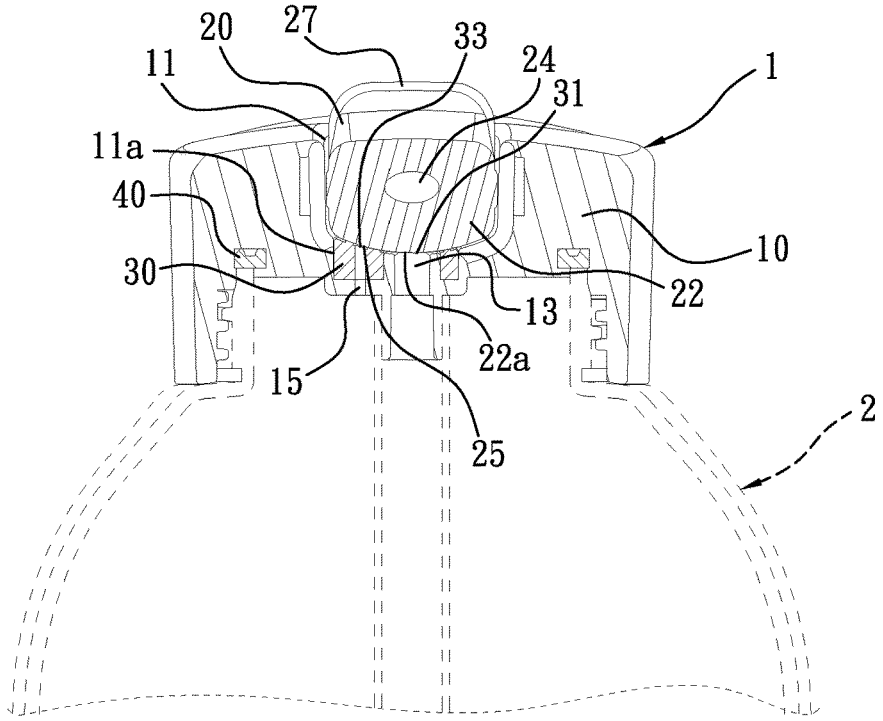
FIG. 7 is a partial enlarged sectional view of the embodiment in FIG. 4 viewed from the front according to the present invention.
Figure 14:
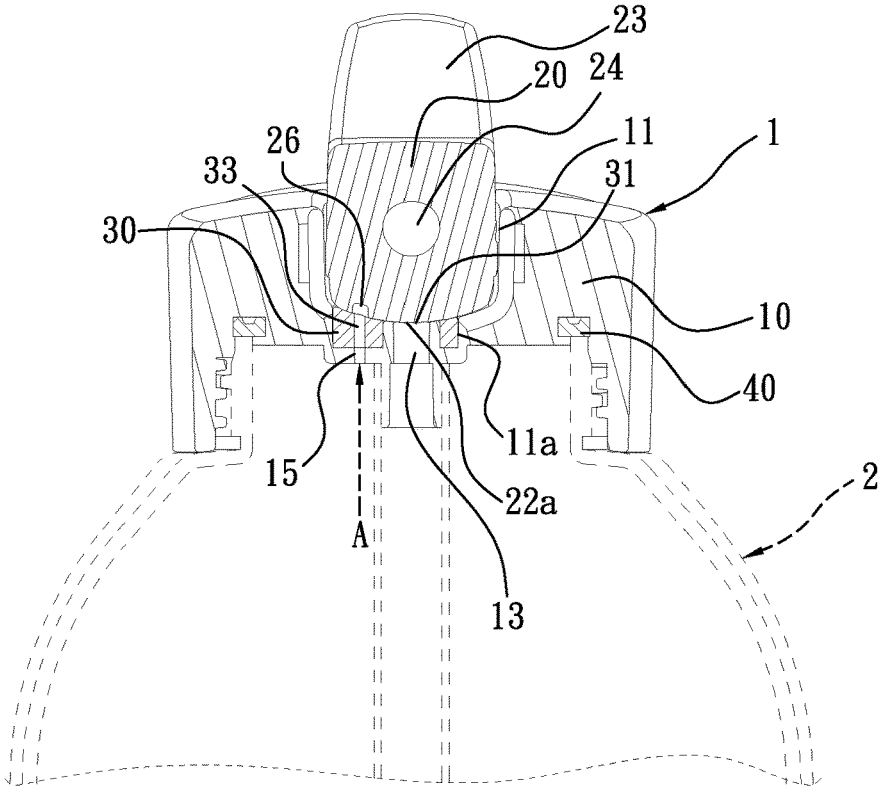
FIG. 14 is a partial enlarged sectional view of the embodiment in FIG. 10 viewed from the front according to the present invention.
Figure 15:
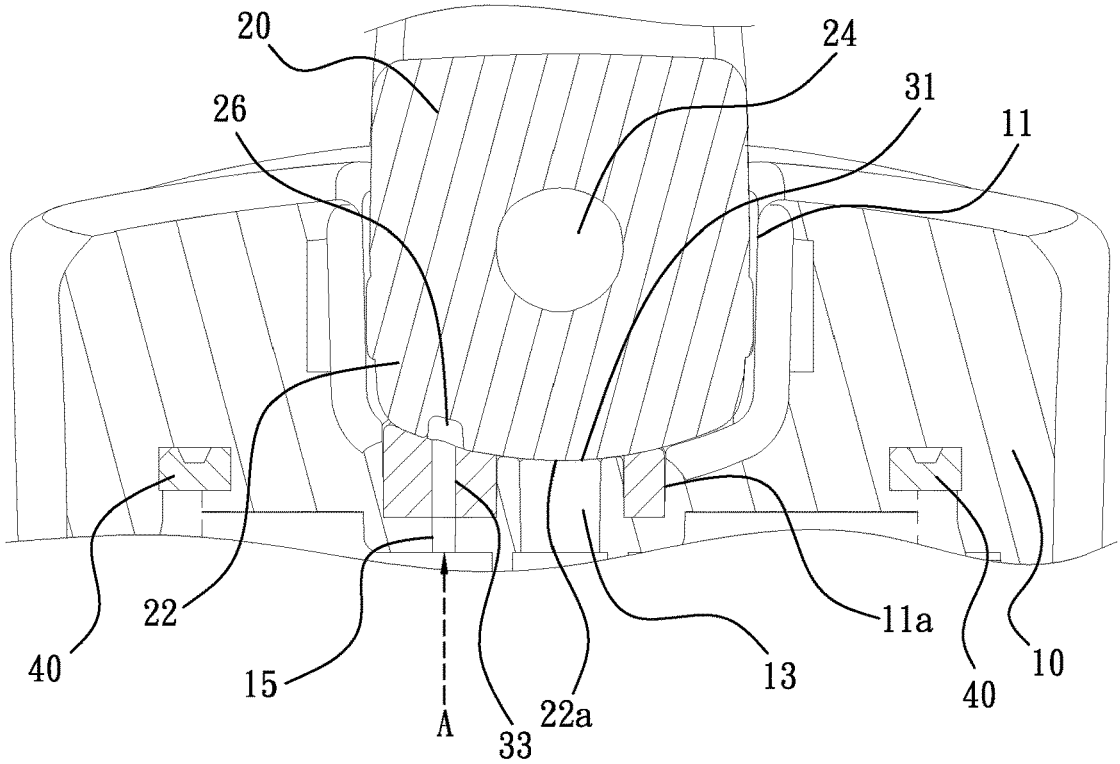
FIG. 15 is a partial enlarged view of the embodiment in FIG. 14 according to the present invention.
Figure 20:
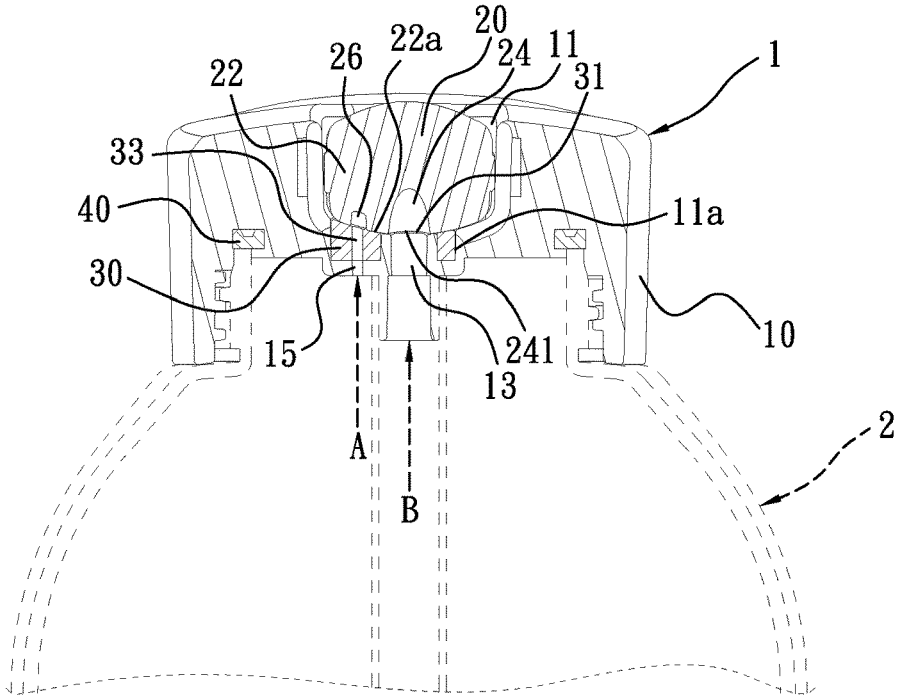
FIG. 20 is a partial enlarged sectional view of the embodiment in FIG. 19 viewed from the front according to the present invention.

The cover 10 is provided with a valve seat 11 disposed on a top surface thereof and having a chamber 11*a*, a liquid through hole 13 with a through-hole edge 14, and at least one vent hole 15 disposed on a periphery of the through-hole edge 14, as shown in FIG. 2. The liquid through hole 13 is disposed on a bottom of the chamber 11*a* and penetrating the cover 10 to communicate with an inner space of the beverage container 2, as shown in FIG. 7, FIG. 14, and FIG. 20.

Figure 1:
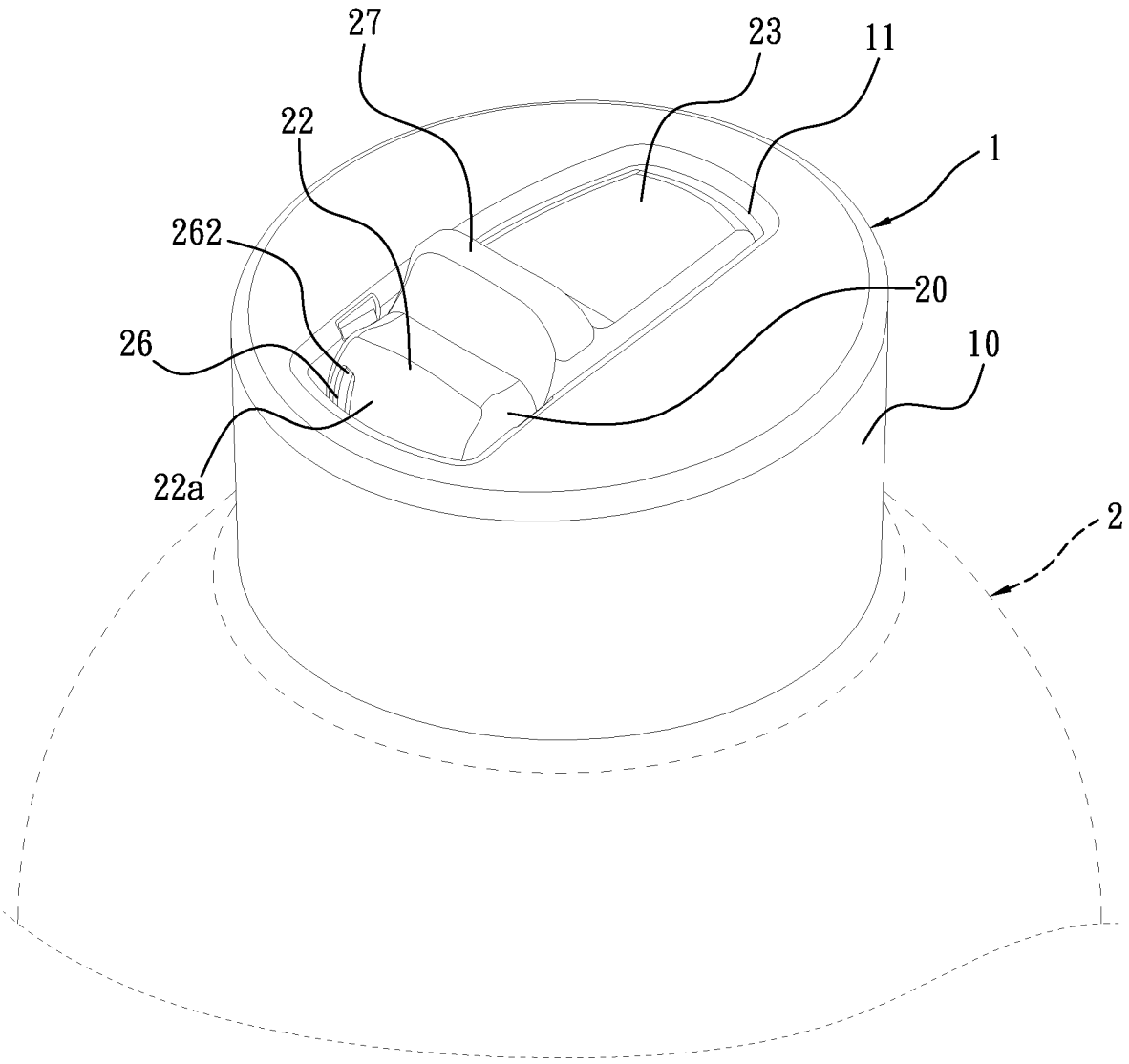
FIG. 1 is a perspective view of an embodiment in which a pivot valve is at a first pivot position according to the present invention.
Figure 8:
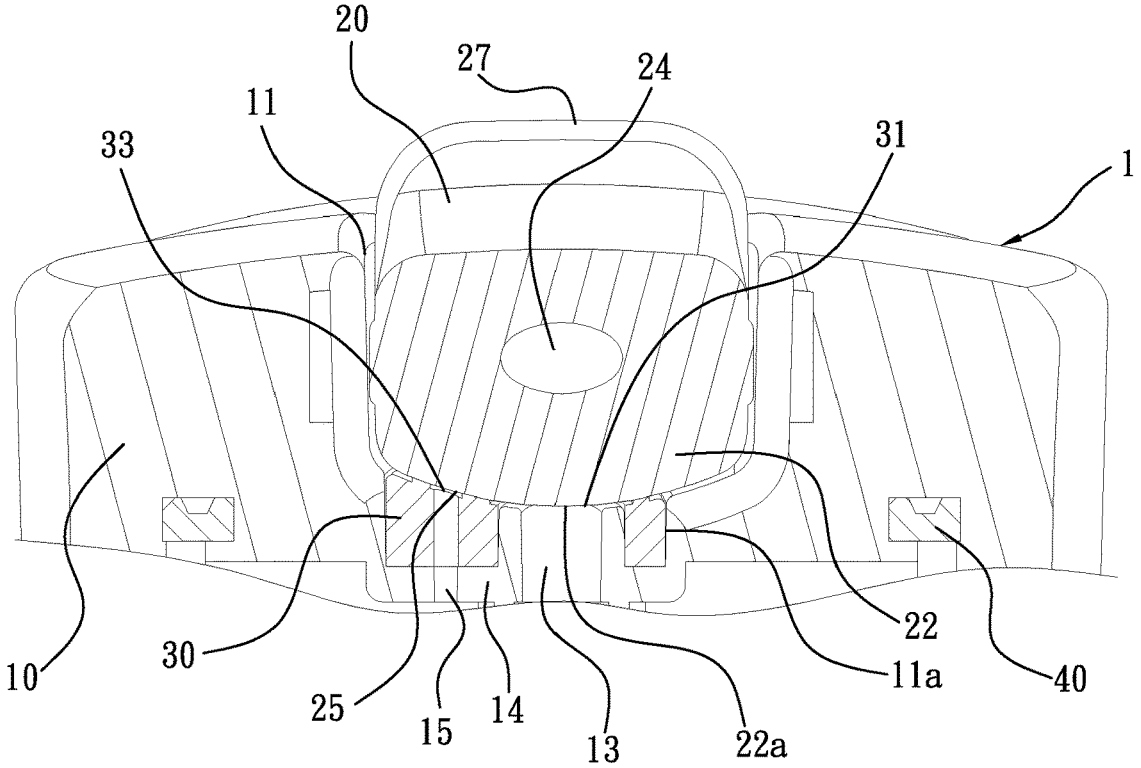
FIG. 8 is a partial enlarged view of the embodiment in FIG. 7 viewed from one side according to the present invention.

Refer to FIG. 1, the waterproof gasket 30 is fixed on the liquid through hole 13 or the through-hole edge 14 on the bottom of the chamber 11*a*, as shown in FIG. 8. The waterproof gasket 30 consists of a flow through hole 31, a flow through hole edge 32 around the flow through hole 31, and at least one air hole 33 arranged at a periphery of the flow through hole edge 32. The flow through hole 31 and the air hole 33 are respectively communicating with the liquid through hole 13 of the cover 10 and the vent hole 15 on the periphery of the through-hole edge 14 of the cover 10, as shown in FIG. 8.

Figure 3:
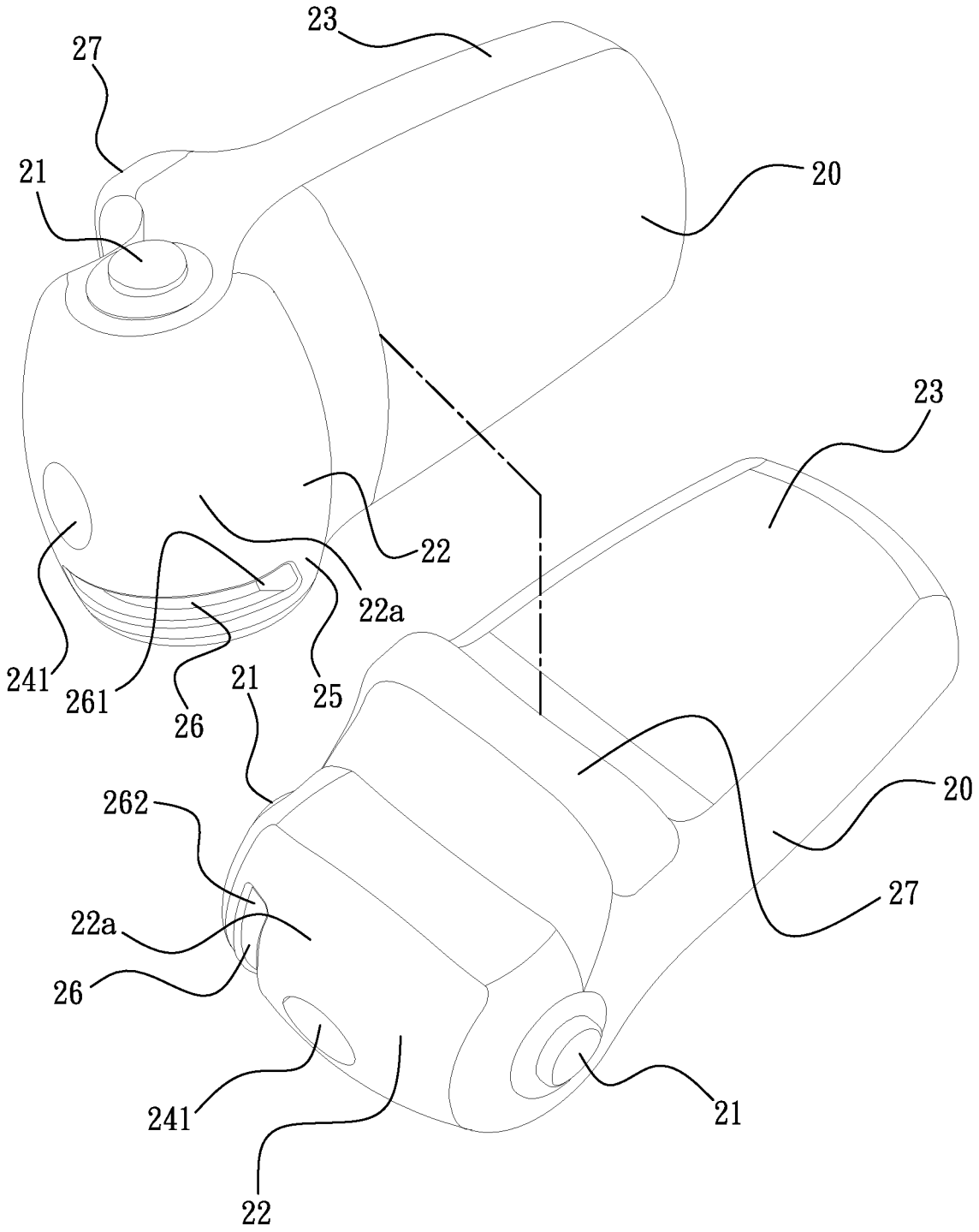
FIG. 3 is a partial enlarged view of the embodiment in FIG. 2 according to the present invention.
Figure 4:
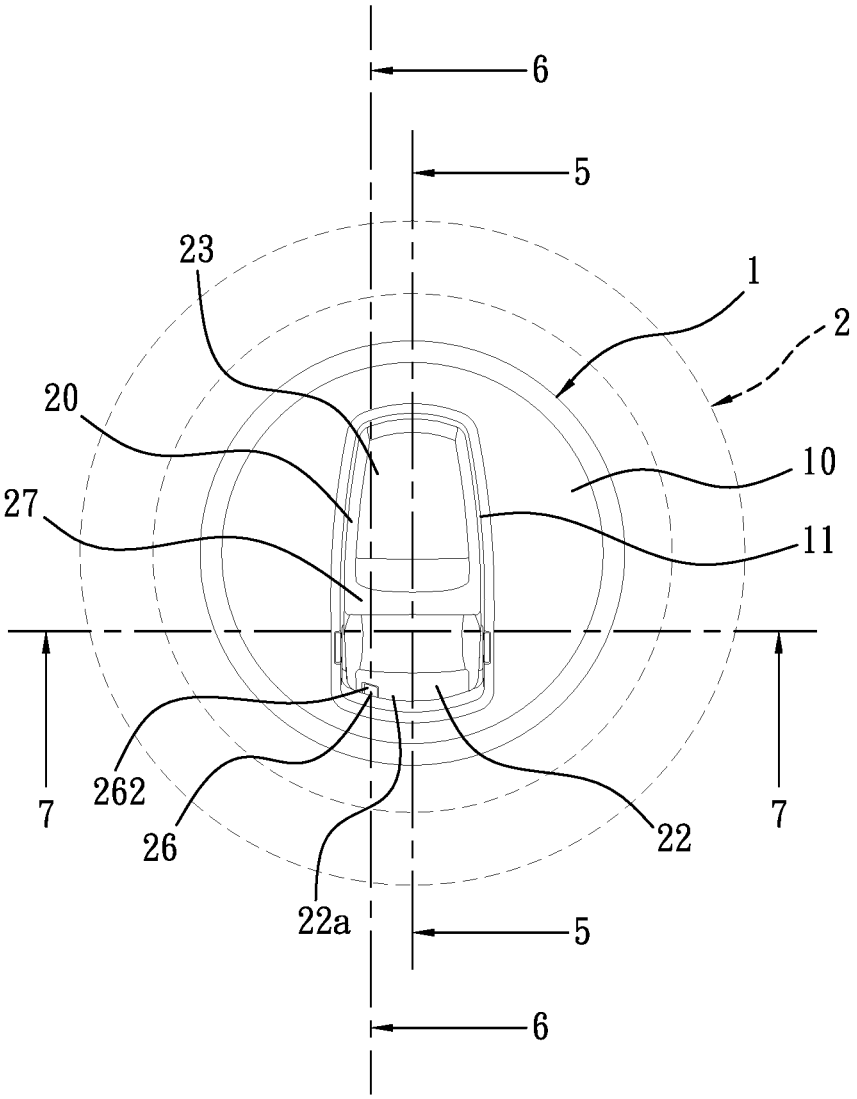
FIG. 4 is a top view of the embodiment in FIG. 1 according to the present invention.
Figure 5:
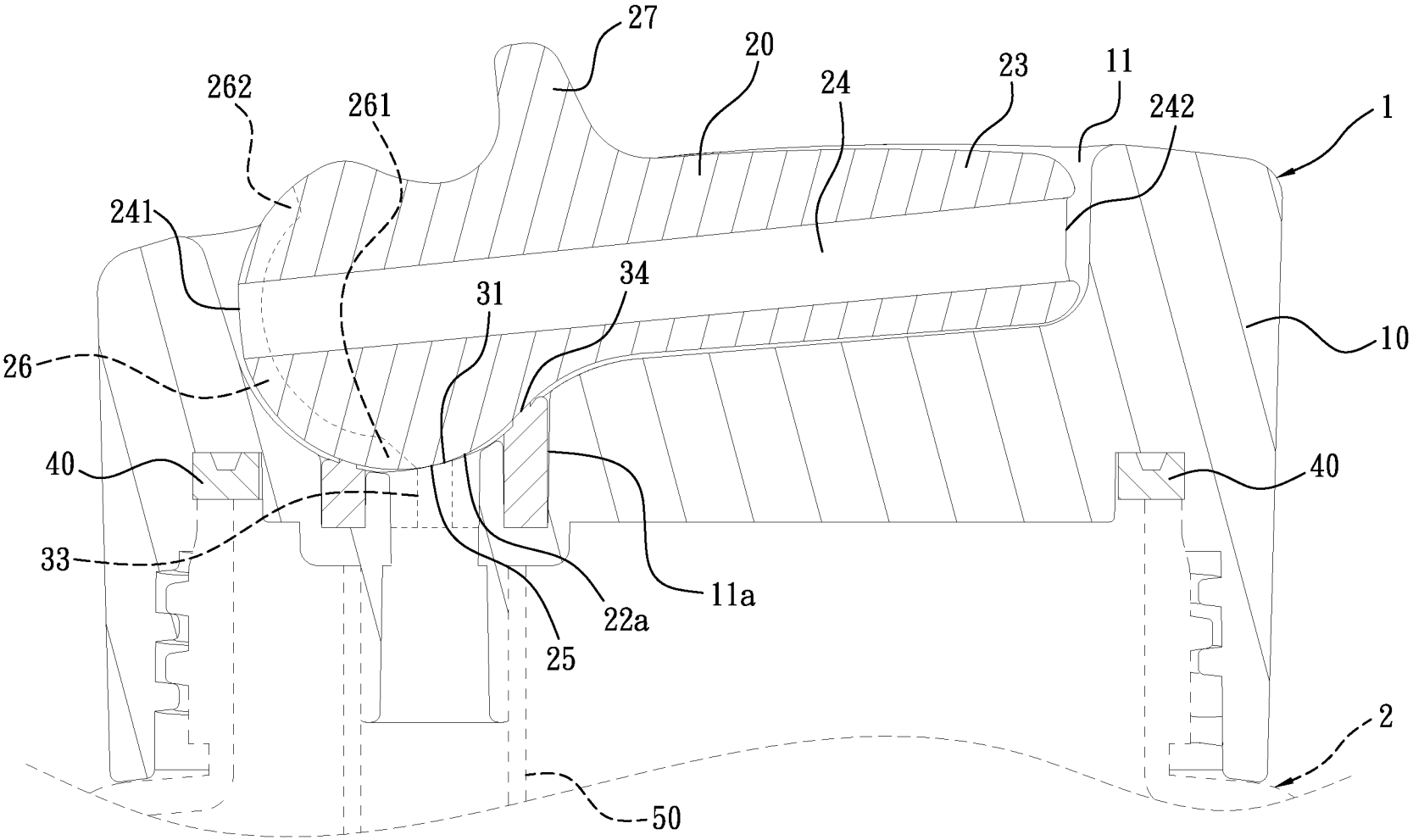
FIG. 5 is a partial enlarged sectional view of the embodiment in FIG. 4 according to the present invention.
Figure 6:
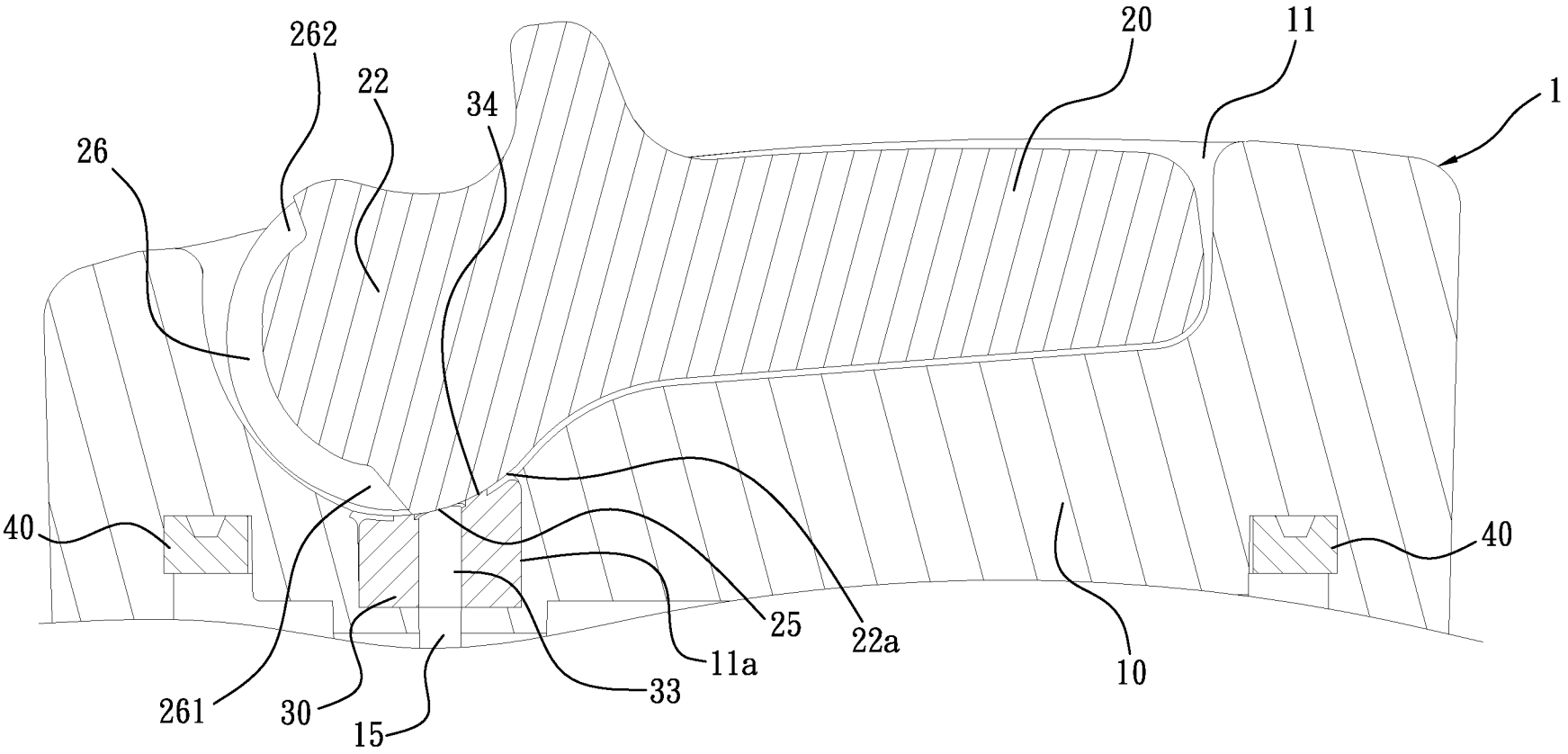
FIG. 6 is a partial enlarged sectional view of the embodiment in FIG. 4 viewed from one side according to the present invention.
Figure 9:
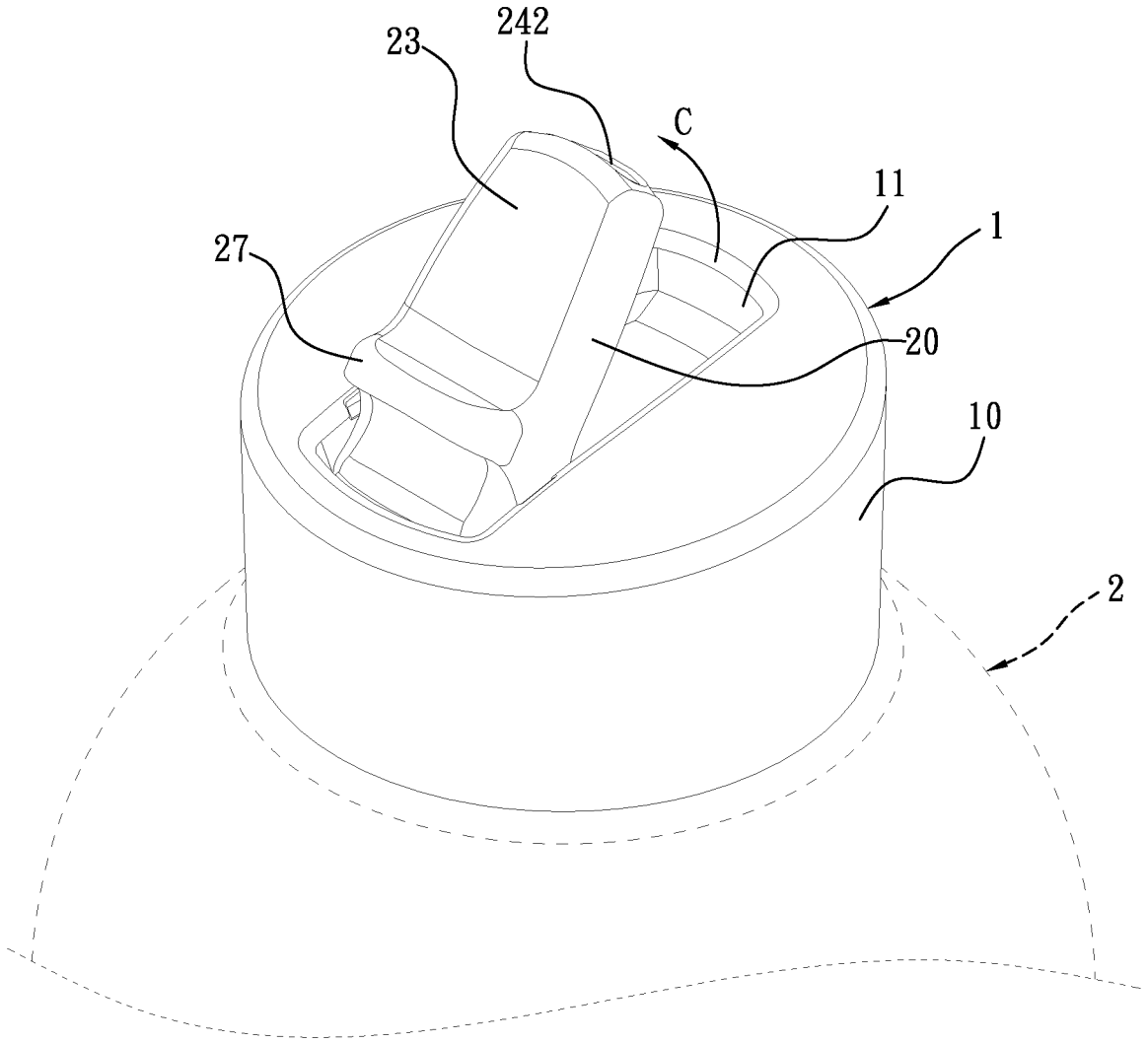
FIG. 9 is a perspective view of an embodiment showing a pivot valve being rotated to be away from a first pivot position according to the present invention.
Figure 10:
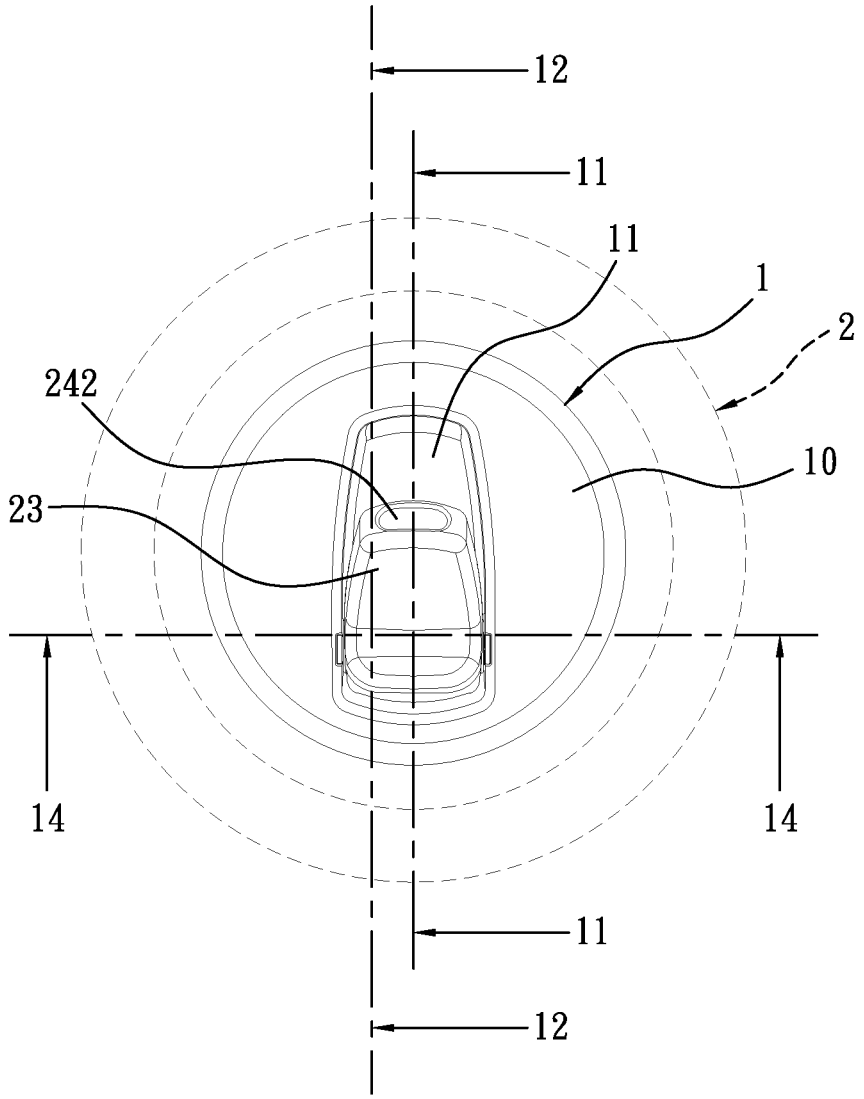
FIG. 10 is a top view of the embodiment in FIG. 9 according to the present invention.
Figure 11:
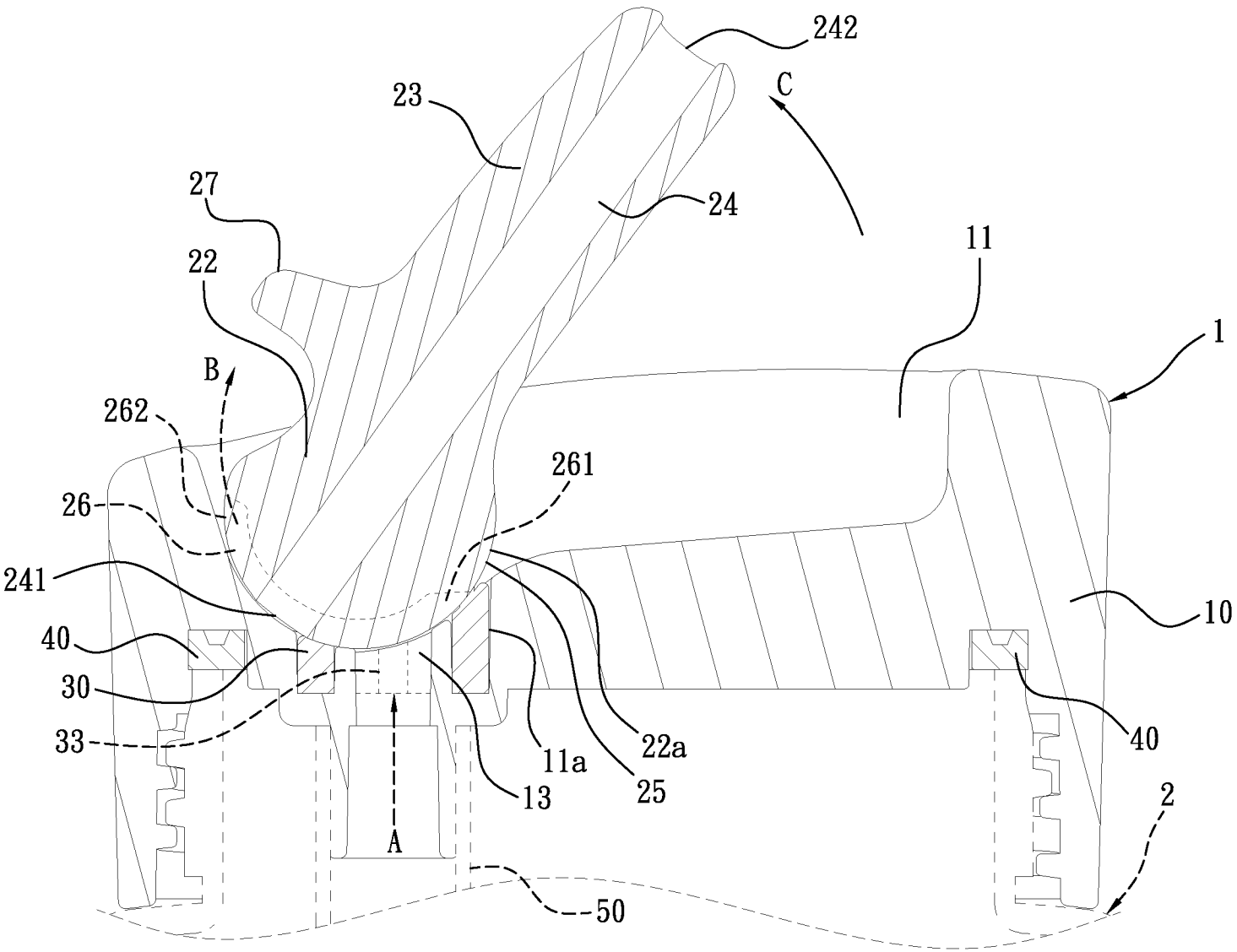
FIG. 11 is a partial enlarged sectional view of the embodiment in FIG. 10 viewed from the side according to the present invention.
Figure 12:
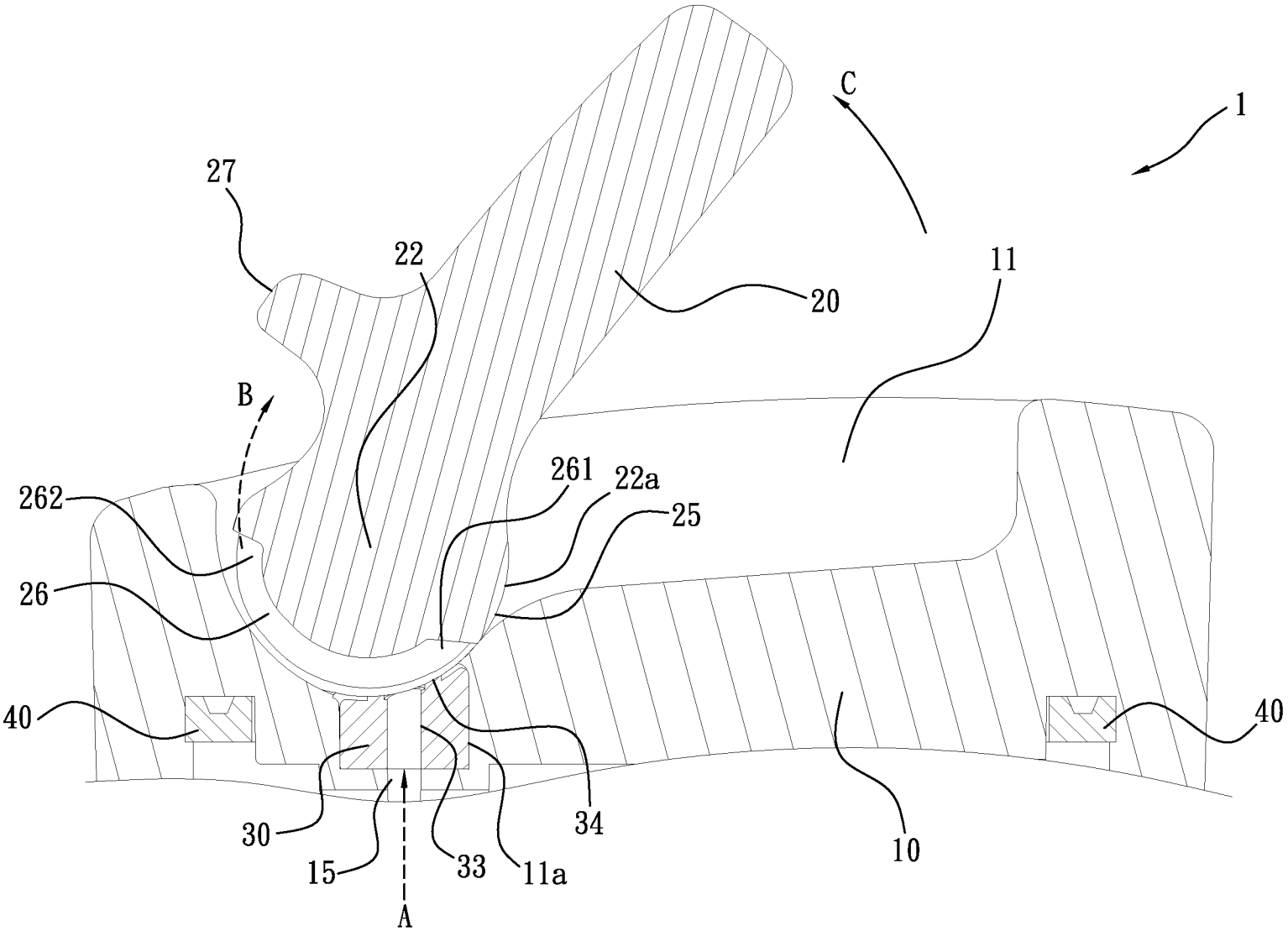
FIG. 12 is a partial enlarged sectional view of the embodiment in FIG. 10 viewed from the side according to the present invention.
Figure 13:
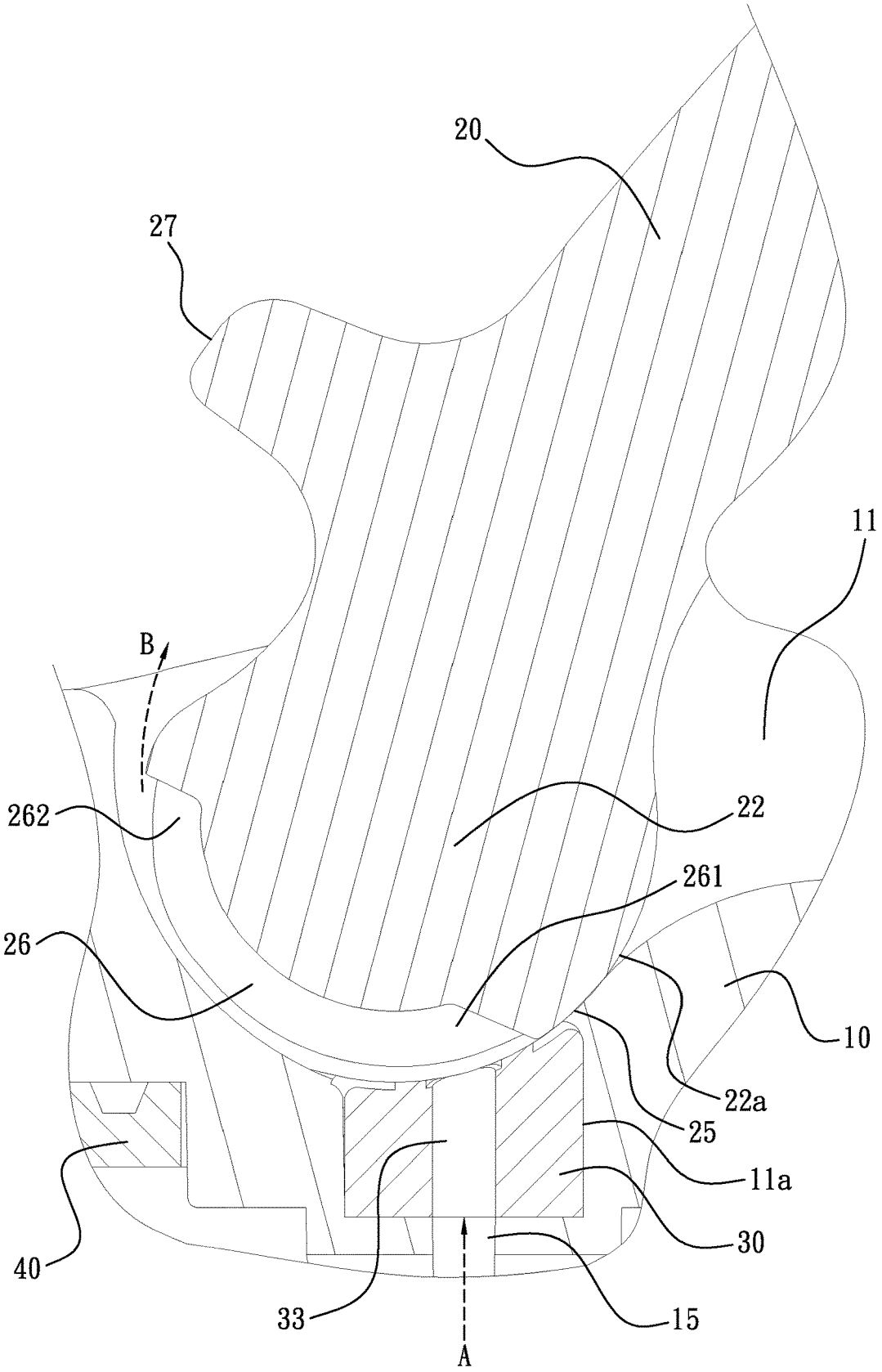
FIG. 13 is a partial enlarged view of the embodiment in FIG. 12 according to the present invention.
Figure 18:
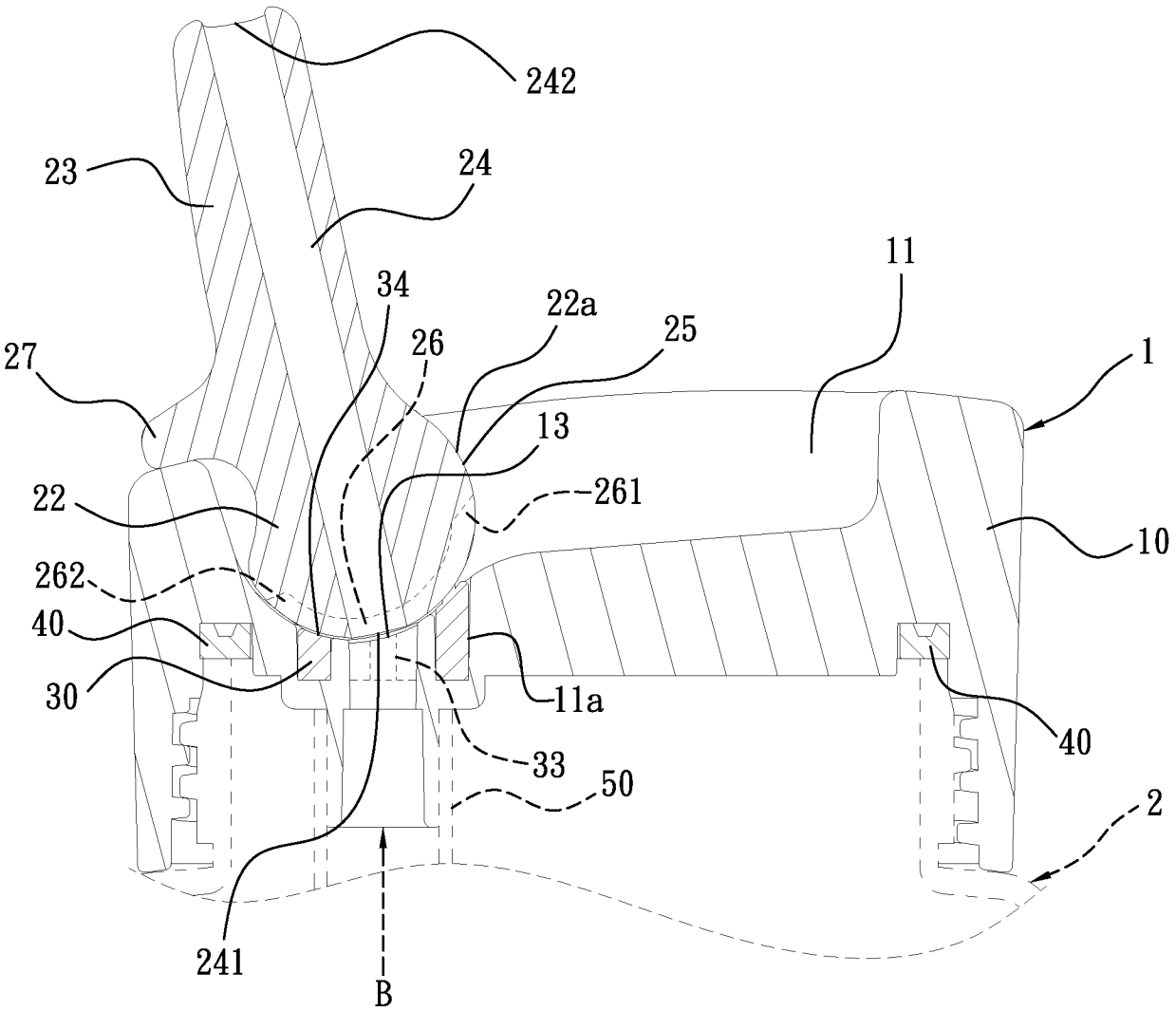
FIG. 18 is a partial enlarged sectional view of the embodiment in FIG. 17 viewed from the side according to the present invention.

The pivot valve 20 is mounted in the chamber 11*a* of the valve seat 11 and able to be rotated, as an arrow C in FIG. 9, FIG. 11, and FIG. 12 indicates. The pivot valve 20 includes a semi-spherical pivot portion 22, a nozzle portion 23, a channel 24, and at least one flange 25. The semi-spherical pivot portion 22 is located at a bottom of the pivot valve 20 and provided with a semi-spherical surface 22*a* while the nozzle portion 23 is formed by extension of the semi-spherical pivot portion 22, as shown in FIG. 3. The semi-spherical surface 22*a* of the semi-spherical pivot portion 22 is compressed and sealed on the flow through hole 31 of the waterproof gasket 30 to create a tight seal, as shown in FIG. 5. The semi-spherical surface 22*a* is rotated along with the pivot valve 20 synchronously from a first pivot position (as shown in FIG. 5) to a second pivot position (as shown in FIG. 18) or rotated in opposite direction. The channel 24 is formed inside the nozzle portion 23 and provided with a water inlet 241 and a water outlet 242 disposed on two ends of the channel correspondingly. The water inlet 241 is extended and located at the semi-spherical surface 22*a* of the pivot valve 20 while the water outlet 242 is located on one end of the nozzle portion 23 opposite to the semi-spherical pivot portion 22 for allowing user's mouth to drink beverages, as shown in FIG. 5, FIG. 11, and FIG. 18. The flange 25 is arranged at a preset position of a periphery of the semi-spherical surface 22*a* of the semi-spherical pivot portion 22, as shown in FIG. 3.

As shown in FIG. 1 and FIG. 5, when the pivot valve 20 is rotated to the first pivot position, the water inlet 241 at the semi-spherical surface 22*a* of the pivot valve 20 is moved away from the flow through hole 31 of the waterproof gasket 30 and the flow through hole 31 of the waterproof gasket 30 is tightly sealed by compression of the semi-spherical surface 22*a*. At the same time, the air hole 33 of the waterproof gasket 30 is also tightly sealed by compression of the flange 25 on the periphery of the semi-spherical surface 22*a*. Thus the lid 1 is in a closed state, as shown in FIG. 7 and FIG. 8.

Figure 16:
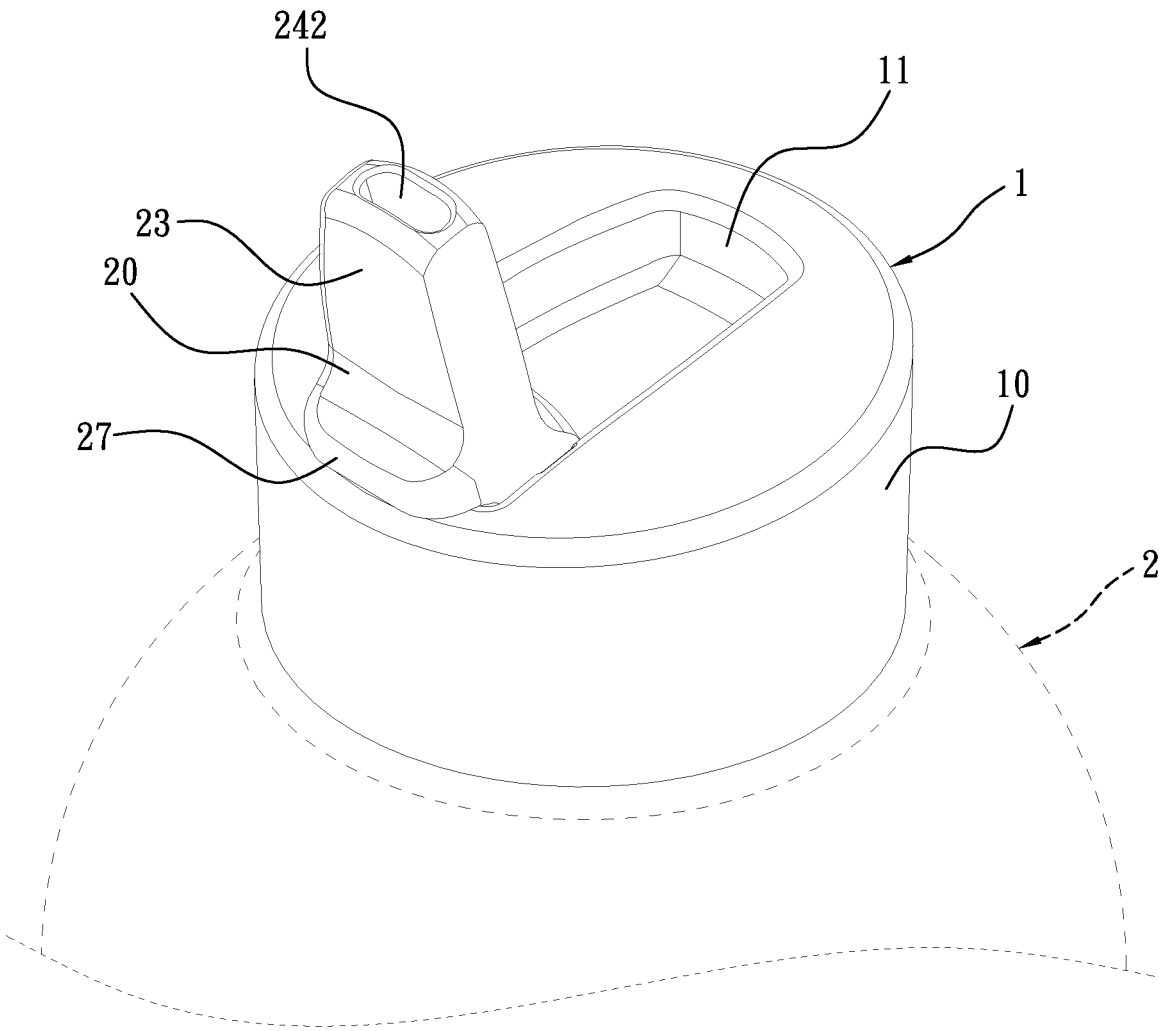
FIG. 16 is a perspective view of an embodiment showing a pivot valve at a second pivot position according to the present invention.
Figure 17:
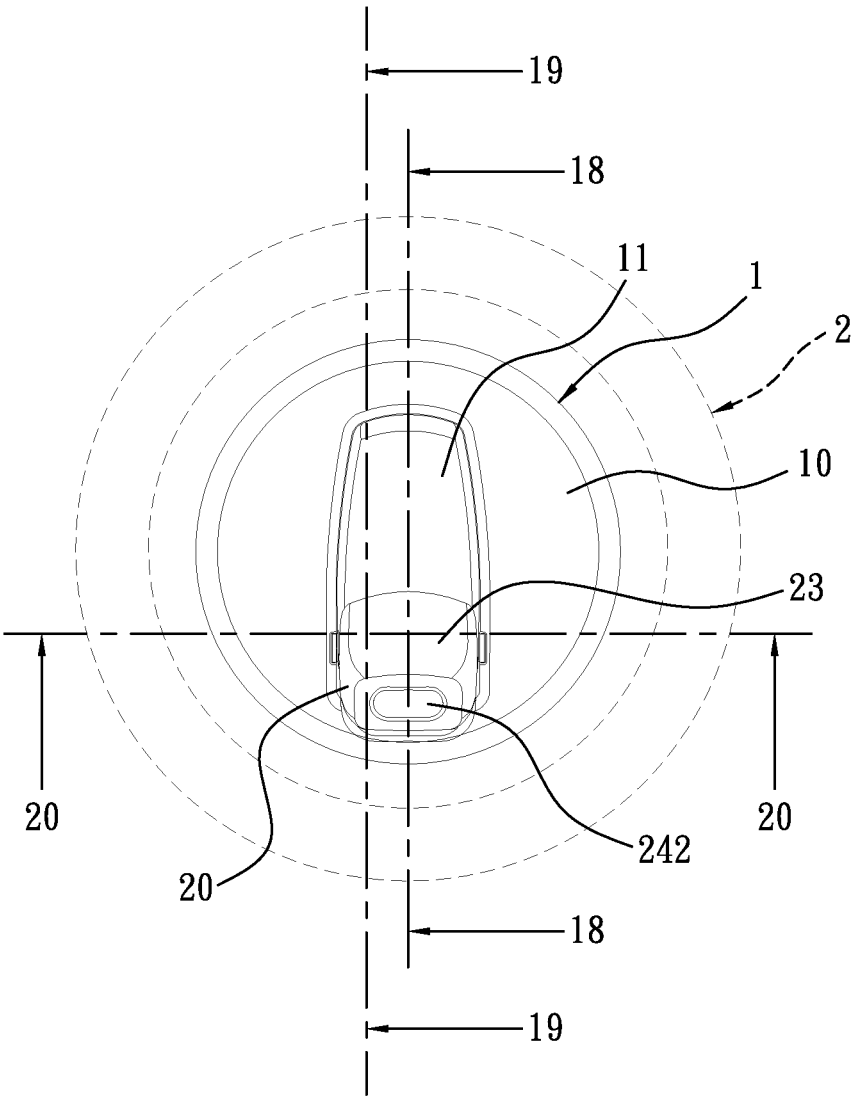
FIG. 17 is a top view of the embodiment in FIG. 16 according to the present invention.
Figure 19:
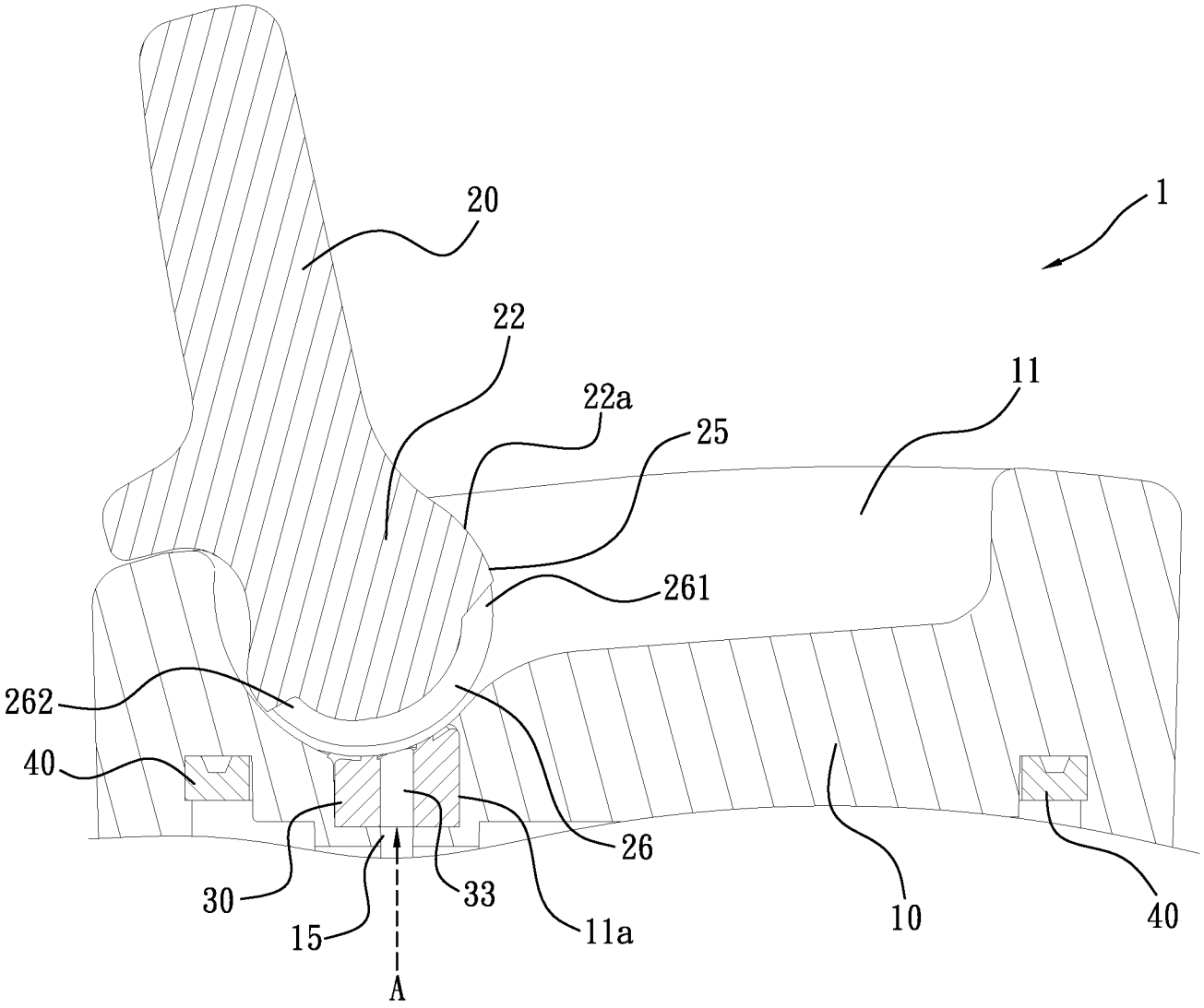
FIG. 19 is a partial enlarged sectional view of the embodiment in FIG. 17 viewed from another side according to the present invention.
Figure 21:
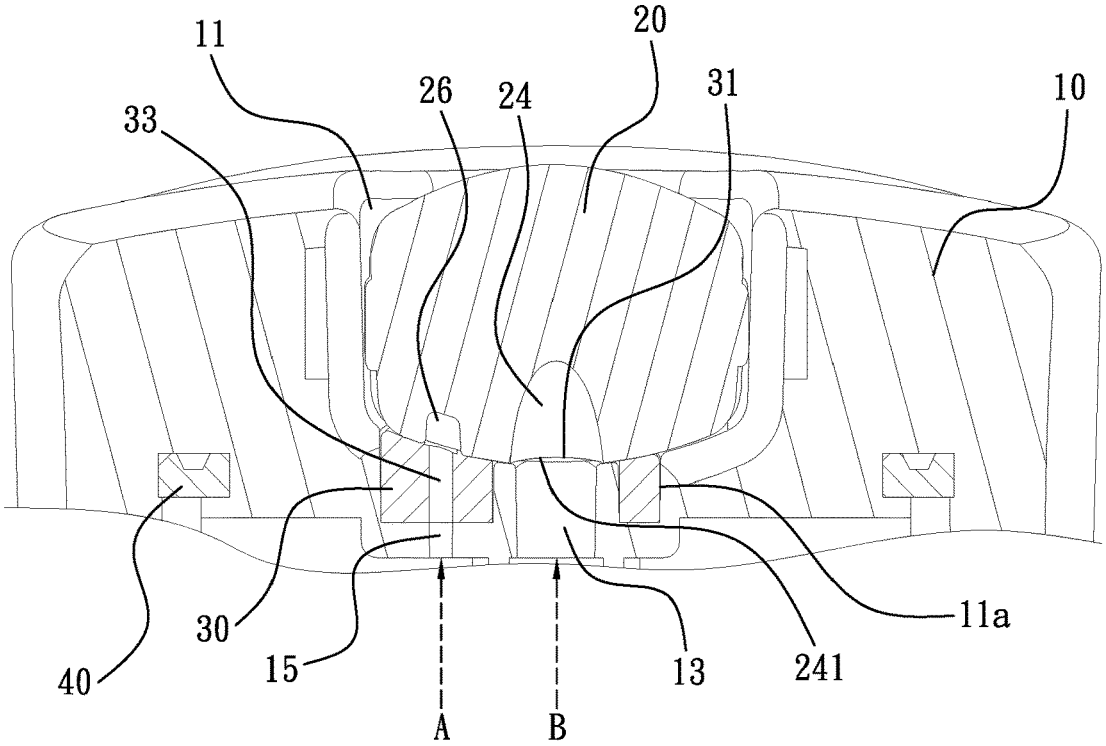
FIG. 21 is a partial enlarged view of the embodiment in FIG. 20 according to the present invention.

As shown in FIG. 16, FIG. 18, and FIG. 19, when the pivot valve 20 is rotated to the second pivot position, the water inlet 241 on the semi-spherical surface 22*a* of the pivot valve 20 is aligned with the flow through hole 31 of the waterproof gasket 30 to be in a communicating state, as an arrow B in FIG. 20 and FIG. 21 indicates. At the same time, the flange 25 on the periphery of the semi-spherical surface 22*a* is away from the air hole 33 of the waterproof gasket 30 so that the air hole 33 of the waterproof gasket 30 is communicating with the outside through the vent hole 15 on the cover 10, as an arrow A in FIG. 20 and FIG. 21 indicates. Thereby the lid 1 is in an open state, as shown in FIG. 20 and FIG. 21.

The present lid features on that a long groove 26 with an opening facing outside is disposed on a surface of the flange 25 around the semi-spherical surface 22*a* of the pivot valve 20 in a pivoting direction, as shown in FIG. 3, FIG. 6, FIG. 12, and FIG. 13. The long groove 26 includes a front end portion 261 and a rear end portion 262 opposite to each other, as shown in FIG. 3, FIG. 6, FIG. 12, FIG. 13, and FIG. 19. When the pivot valve 20 is rotated (as shown in FIG. 1 and FIG. 5) to be away from the first pivot position (as shown in FIG. 9 to FIG. 12), the front end portion 261 of the long groove 26 is communicating with the air hole 33 of the waterproof gasket 30 (as an arrow A in FIG. 11 and FIG. 13-15 indicates). Thus air inside the beverage container 2 can be flowing to the outside through the long groove 26 and the rear end portion 262 of the long groove 26, as shown in FIG. 11 and FIG. 12. Thereby gases inside the beverage container 2 can be discharged to the outside for reducing pressure inside the beverage container 2 before the user rotating the pivot valve 20 to the second pivot position. The problem of the beverage container available now with drinks (such as carbonated drinks or beverages at high temperature) sprayed out through the pivot valve due to high pressure of gases in the beverage container can be solved.

Refer to FIG. 2, the waterproof gasket 30 further includes a concave surface 34 which is able to attach to the semi-spherical surface 22*a* of the pivot valve 20 correspondingly, as shown in FIG. 5 and FIG. 18. While the pivot valve 20 is rotated from the first pivot position (as shown in FIG. 5) to the second pivot position (as shown in FIG. 18) or in opposite direction, the semi-spherical surface 22*a* of the pivot valve 20 is attached to and sliding on the concave surface 34.

Refer to FIG. 2, both the cover 10 and the pivot valve 20 are integrally formed by plastic injection molding, but not limited, and this is suitable for mass production. The waterproof gasket 30 is integrally formed by silicone molding for improving safety in use.

Refer to FIG. 2 and FIG. 5, the two opposite inner walls of the chamber 11*a* of the valve seat 11 are provided with two opposite pivot slots 12 correspondingly while each of two opposite lateral surfaces of the pivot valve 20 is provided with a protrudent pivot shaft 21 for pivotally connection with the pivot slot 12. The valve seat 11 is recessed from and located under the top surface of the cover 10.

Refer to FIG. 1, FIG. 9, and FIG. 16, the pivot valve 20 further includes a holding portion 27 for allowing the user to pivotally rotate the pivot valve 20 conveniently.

Refer to FIG. 5, FIG. 11, and FIG. 18, the lid 1 further includes a circular waterproof gasket 50 which is mounted inside the cover 10 and integrally formed by silicone molding. The lid 1 is further provided with a straw 50 which is arranged in the cover 10 and communicating with the liquid through hole 13 of the cover 10 so that the user can drink beverages easily.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

The invention claimed is:

1. A beverage container lid comprising a cover, a pivot valve, and a waterproof gasket; wherein the cover is detachably mounted to an opening on a top end of a beverage container and provided with a valve seat disposed on a top surface thereof and having a chamber, a liquid through hole with a through-hole edge, and at least one vent hole arranged at a periphery of the through-hole edge; wherein the liquid through hole is disposed on a bottom of the chamber and penetrating the cover to communicate with an inner space of the beverage container; wherein the waterproof gasket is correspondingly fixed on the liquid through hole or the through-hole edge on the bottom of the chamber; the waterproof gasket consists of a flow through hole, a flow through hole edge of the flow through hole, and at least one air hole arranged at a periphery of the flow through hole edge; the flow through hole and the at least one air hole are respectively communicating with the liquid through hole of the cover and the at least one vent hole at the periphery of the through-hole edge of the cover; wherein the pivot valve is mounted in the chamber of the valve seat and able to be rotated; the pivot valve includes a semi-spherical pivot portion, a nozzle portion, a channel, and at least one flange; the semi-spherical pivot portion is located at a bottom of the pivot valve and provided with a semi-spherical surface while the nozzle portion is formed by extension of the semi-spherical pivot portion; the semi-spherical surface of the semi-spherical pivot portion is compressed on the flow through hole of the waterproof gasket to create a tight seal; the semi-spherical surface is able to be rotated from a first pivot position to a second pivot position or in a reverse direction along with the pivot valve; wherein the channel is mounted inside the nozzle portion and provided with a water inlet and a water outlet disposed on two ends of the channel correspondingly; the water inlet is extended and located at the semi-spherical surface of the semi-spherical pivot portion while the water outlet is located on one end of the nozzle portion opposite to the semi-spherical pivot portion for allowing user's mouth to drink; wherein the at least one flange is arranged at a preset position of a periphery of the semi-spherical surface of the semi-spherical pivot portion; when the pivot valve is rotated to the first pivot position, the water inlet on the semi-spherical surface of the pivot valve is moved away from the flow through hole of the waterproof gasket while the flow through hole of the waterproof gasket is tightly sealed by compression of the semi-spherical surface; while, the at least one air hole of the waterproof gasket is tightly sealed by compression of the at least one flange on the periphery of the semi-spherical surface; thus the lid is in a closed state; when the pivot valve is rotated to the second pivot position, the water inlet on the semi-spherical surface of the pivot valve is aligned with the flow through hole of the waterproof gasket to be in a communicating state; while, the at least one flange on the periphery of the semi-spherical surface is away from the at least one air hole of the waterproof gasket so that the at least one air hole of the waterproof gasket is communicating with outside through the at least one vent hole on the cover; thus the lid is in an open state;

wherein a long groove with an opening facing outside is disposed on a surface of the at least one flange on the periphery of the semi-spherical surface of the pivot valve in a pivoting direction; the long groove includes a front end portion and a rear end portion opposite to each other; wherein the front end portion of the long groove is communicating with the at least one air hole of the waterproof gasket when the pivot valve is rotated to be away from the first pivot position so that air inside the beverage container is flowing to the outside through the long groove and the rear end portion of the long groove.

2. The beverage container lid as claimed in claim 1, wherein the waterproof gasket further includes a concave surface which is able to attach to the semi-spherical surface of the pivot valve correspondingly; wherein while the pivot valve is rotated from the first pivot position to the second pivot position or in opposite direction, the semi-spherical surface of the pivot valve is attached to and sliding on the concave surface.

3. The beverage container lid as claimed in claim 1, wherein both the cover and the pivot valve are integrally formed by plastic injection molding.

4. The beverage container lid as claimed in claim 1, wherein the waterproof gasket is integrally formed by silicone molding.

5. The beverage container lid as claimed in claim 1, wherein two opposite inner walls of the chamber of the valve seat are provided with two opposite pivot slots correspondingly while each of two opposite lateral surfaces of the pivot valve is provided with a protrudent pivot shaft for pivotally connection with a pivot slot, among the two opposite pivot slots.

6. The beverage container lid as claimed in claim 1, wherein the valve seat is recessed from and located under the top surface of the cover.

* * * * *